US007784524B2

(12) United States Patent
Ide et al.

(10) Patent No.: US 7,784,524 B2
(45) Date of Patent: Aug. 31, 2010

(54) APPARATUS AND METHOD FOR PRODUCING CASTING MOLD

(75) Inventors: Isamu Ide, Sakai (JP); Toru Seki, Sakai (JP); Sadao Maeda, Okazaki (JP); Keizo Nishiyama, Handa (JP)

(73) Assignees: Lignyte Co., Ltd., Osaka (JP); Maeda Shell Service Co., Ltd., Aichi (JP)

( * ) Notice: Subject to any disclaimer, the term of this patent is extended or adjusted under 35 U.S.C. 154(b) by 517 days.

(21) Appl. No.: 11/667,776

(22) PCT Filed: Nov. 18, 2004

(86) PCT No.: PCT/JP2004/017175

§ 371 (c)(1),
(2), (4) Date: Sep. 20, 2007

(87) PCT Pub. No.: WO2006/054346

PCT Pub. Date: May 26, 2006

(65) Prior Publication Data

US 2008/0078523 A1 Apr. 3, 2008

(51) Int. Cl.
*B22C 9/12* (2006.01)

(52) U.S. Cl. ..... 164/16; 164/12

(58) Field of Classification Search ..... 164/12, 164/16

See application file for complete search history.

(56) References Cited

U.S. PATENT DOCUMENTS 5,162,393 A * 11/1992 Griffin et al. ..... 523/145
6,467,525 B2 10/2002 Herreid et al.

FOREIGN PATENT DOCUMENTS

| | | | |
|---|---|---|---|
| JP | 57-25245 | * | 2/1982 |
| JP | 57-109544 | A | 7/1982 |
| JP | 2000-061583 | A | 2/2000 |
| JP | 2000-79444 | A | 3/2000 |
| JP | 2000-084641 | A | 3/2000 |
| JP | 2000-107835 | A | 4/2000 |

OTHER PUBLICATIONS

International Search Report, Mar. 1, 2005.
Supplementary European Search Report for the Application No. EP 04 82 2663, dated Oct. 15, 2007.

* cited by examiner

*Primary Examiner*—Kuang Lin
(74) *Attorney, Agent, or Firm*—Cheng Law Group, PLLC

(57) ABSTRACT

An apparatus and a method for producing a casting mold are provided, according to which the casting mold having a complex shape can be obtained with stable quality. The apparatus comprises a mold having a cavity therein, a steam supply unit, a steam supply passage connected to the cavity, steam discharge passages, flow regulators disposed in the steam discharge passages to regulate an amount of the steam discharged from the cavity, and a control unit for controlling the flow regulators. After a resin-coated sand prepared by coating a refractory aggregate with a binder resin is injected into the cavity of the heated mold, superheated steam is supplied into the cavity. At this time, the control unit controls the flow regulators such that the cavity is uniformly filled with the superheated steam.

10 Claims, 2 Drawing Sheets

APPARATUS AND METHOD FOR PRODUCING CASTING MOLD

TECHNICAL FIELD

The present invention relates to an apparatus and a method for producing a casting mold, which is used for casting.

BACKGROUND ART

In the past, a production method of a casting mold has been known, which comprises the steps of filling a cavity of a heated metal mold with a resin-coated sand prepared by coating a refractory aggregate with a binder material such as thermosetting resin, and then thermally curing the binder material. According to this method, the casting mold can be produced with high productivity and stable quality. However, since it is needed to heat the metal mold at a high temperature, there is a problem that toxic substances such as ammonia gas and formaldehyde occur from a rapid reaction accompanied when the binder material such as phenol resin is cured, and consequently lead to a deterioration of working conditions.

To improve these problems, for example, Japanese Patent Early Publication No. 2000-107835 discloses a method for stably producing a casting mold within a reduced time period, while preventing the deterioration of working conditions. This method is characterized by filling the resin-coated sand in a metal mold, and then supplying superheated steam in the metal mold to instantly cure the binder material. Since heat of the superheated steam is instantly transmitted to the inside resin-coated sand, which does not contact the metal mold, the casting mold can be produced within a short time period even when the metal mold is heated at a temperature lower than before. In addition, there is an advantage of remarkably reducing the generation of toxic gas species.

However, in the case of producing the casting mold having a complex shape, since it is difficult to uniformly supply the superheated steam all over the resin-coated sand filled in a cavity of the metal mold, there is a possibility that variations in quality of the casting mold occur due to insufficient curing. In addition, when the resin-coated sand filled in the metal mold has a low void fraction, it is hard to allow the superheated steam to pass through the resin-coated sand, as compared with the case that the void fraction is high. As a result, there is another problem of preventing a uniform supply of heat into the filled resin-coated sand.

SUMMARY OF THE INVENTION

In view of the above problems, a primary concern of the present invention is to provide an apparatus for producing a casting mold, which has the capability of producing the casting mold having a complex shape with stable quality, while maintaining high production efficiency and safe working conditions.

That is, the apparatus of the present invention comprises:

a mold having a cavity therein;

a steam supply unit configured to supply superheated steam into the cavity;

a plurality of steam discharge passages configured to discharge the superheated steam from the cavity;

a flow regulator disposed at least one of the steam discharge passages to regulate an amount of the steam discharged from the cavity; and a control unit configured to control the flow regulator such that the cavity is uniformly filled with the superheated steam.

In the apparatus of the present invention, it is preferred that a temperature sensor is located in the vicinity of an entrance of each of the steam discharge passages, and the control unit controls the flow regulator such that a temperature detected by the temperature sensor is within a predetermined temperature range.

It is also preferred that the flow regulator comprises an electromagnetic valve, and the control unit controls an opening amount of the electromagnetic valve. Further, it is preferred that the apparatus of the present invention comprises a suction pump connected to at least one of the steam discharge passages, and the control unit controls a discharge amount of the suction pump.

As a particularly preferred embodiment of the present invention, the flow regulator comprises an electromagnetic valve. A suction pump is connected to a discharge port, which is formed at a confluence portion of ends of the steam discharge passages. The control unit controls an opening amount of the electromagnetic valve and a discharge amount of the suction pump. In this case, the purpose of the present invention can be more effectively achieved, as described later.

In addition, the control unit preferably controls the flow regulator according to a void fraction of a resin-coated sand filled in the cavity. The void fraction of the resin-coated sand gives a large influence on the permeation of steam into the resin-coated sand filled in the cavity. Therefore, controlling according to this parameter is effective to further improve the uniformity of temperature distribution in the cavity.

Another concern of the present invention is to provide a production method for achieving the above-described purposes. That is, the production method of the present invention performed by use of the apparatus described above comprises the steps:

filling a resin-coated sand, which is prepared by coating a refractory aggregate with a binder resin, in the cavity of the mold heated at an increased temperature; and curing the resin-coated sand by supplying the superheated steam into the cavity under a steam pressure of 1.5~10 kgf/$cm^2$ at a curing temperature or more of the resin-coated sand;

wherein the control unit controls the flow regulator in the curing step such that the cavity is uniformly filled with the superheated steam.

In this production method, the control unit preferably controls the flow regulator according to a control parameter comprising at least one of a temperature in the steam discharge passage, and a void fraction of the resin-coated sand filled in the cavity. By controlling these parameters, it is possible to reliably provide a uniform temperature distribution in the cavity of the mold.

Further purposes and effects of the present invention will be more clearly understood from the best mode for carrying out the invention described below.

BEST MODE FOR CARRYING OUT THE INVENTION

Referring to the attached drawings, an apparatus and a method for producing a casting mold of the present invention are explained below in detail according to preferred embodiments.

Figure 1:
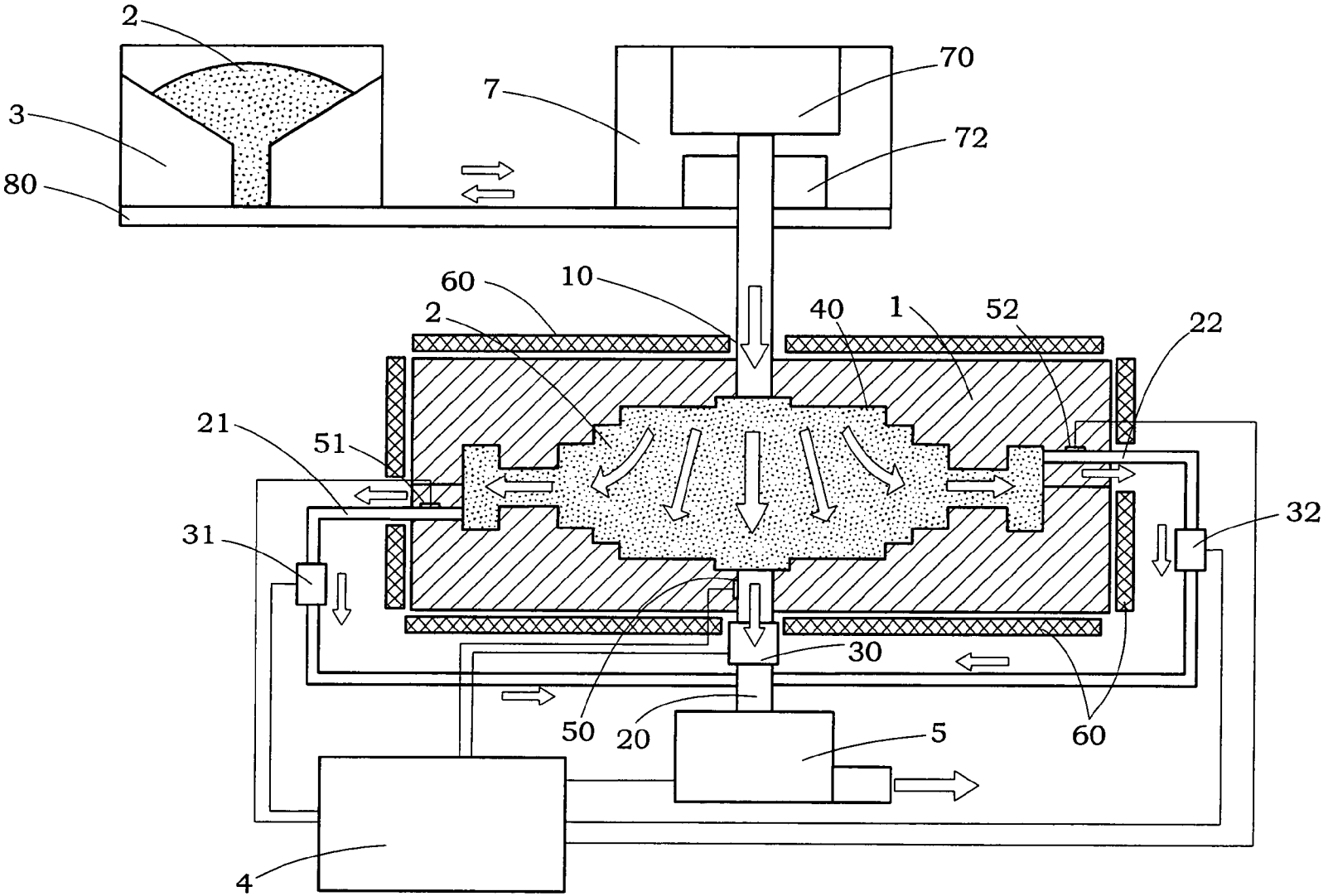
FIG. 1 is a schematic view of an apparatus of producing a casting mold according to a preferred embodiment of the present invention.

As shown in FIG. 1, the apparatus for producing the casing mold according to the subject embodiment is mainly composed of a mold 1 having a cavity 40 of a desired shape therein, a sand supply unit 3 for supplying a resin-coated sand into the cavity, a steam supply unit 7 for supplying superheated steam into the cavity, a steam supply passage 10 used to supply the superheated steam from the steam supply unit 7 into the cavity 40, a plurality of steam discharge passages (20, 21, 22) for discharging the superheated steam from the cavity, electromagnetic valves (30, 31, 32) disposed at the steam discharge passages, a suction pump 5 connected to a discharge port, which is formed at a confluence portion of ends of the steam discharge passages, and a control unit 4 for controlling the suction pump and the electromagnetic valves such that the cavity is uniformly filled with the superheated steam. In the drawing, the numeral 2 designates the resin-coated sand filled in the cavity, which is prepared by coating a refractory aggregate with a binder resin such as thermosetting resin. The numeral 60 designates a heater used to heat the mold. If necessary, a serge tank may be disposed at the upstream side of the suction pump.

As a material for the mold 1, a metal material or a heat-resistant resin material is available. The structure and the shape of the mold are not specifically limited. For example, the mold may be formed with a plurality of segment patterns, which can be coupled to each other to obtain the cavity of a desired shape in the mold. The mold 1 shown in FIG. 1 can be divided into upper and lower patterns, and the cavity 40 is obtained in the mold by coupling them to each other.

The sand supply unit 3 is slidable on a rail 80, and can be connected to the steam supply passage 10. When the steam supply passage 10 is connected to the sand supply unit 3, it functions as a sand supply passage for injecting the resin-coated sand 2 into the cavity 40.

The steam supply unit 7 comprises a steam generator 70 for generating steam having, for example, a temperature of 110° C. to 180° C., and a heating device 72 for generating superheated steam by raising the steam temperature without considerably increasing the pressure of the steam supplied from the steam generator 70. To superheat the steam, it is preferred to use a microwave. The superheated steam is defined as a steam obtained by further heating a saturated steam at its saturation temperature or more. In the present invention, the superheated steam supplied into the cavity preferably has a steam pressure of 1.5~10 kgf/cm$^2$ and a temperature of 150° C. to 700° C., more preferably 200° C. to 600° C.

As shown in FIG. 1, when the cavity 40 is formed by coupling the segment patterns, a sealing material is preferably disposed at the coupling potion therebetween to prevent a leakage of the superheated steam. Specifically, it is preferred that a concave is formed in the coupling portion of the mold to place an expandable rubber as the sealing material therein, and an air supply passage is formed to supply the air into the sealing material. In this case, since the sealing material is expanded by the air supplied through the air supply passage, and the expanded sealing material is pressed against coupling surfaces of the segment patterns, it is possible to effectively prevent the leakage of the superheated steam. In addition, there is an advantage that the casting mold can be safely produced without causing a deterioration of working conditions.

An opening amount of each of the electromagnetic valves (31, 32, 33) used as flow regulators is controlled by the control unit 4 according to an output of a temperature sensor (50, 51, 52) located in the vicinity of an entrance of the corresponding steam discharge passage. That is, an amount of the steam sucked in the respective steam discharge passage changes with the opening amount of the corresponding electromagnetic valve. Therefore, when the steam discharge passage is formed at a region of the cavity of the complex shape where the steam is hard to reach, and the opening amount of the electromagnetic valve is controlled such that a temperature detected by the temperature sensor located in the steam discharge passage is within a desired temperature range, the steam can be uniformly supplied all over the cavity.

Figure 2A:
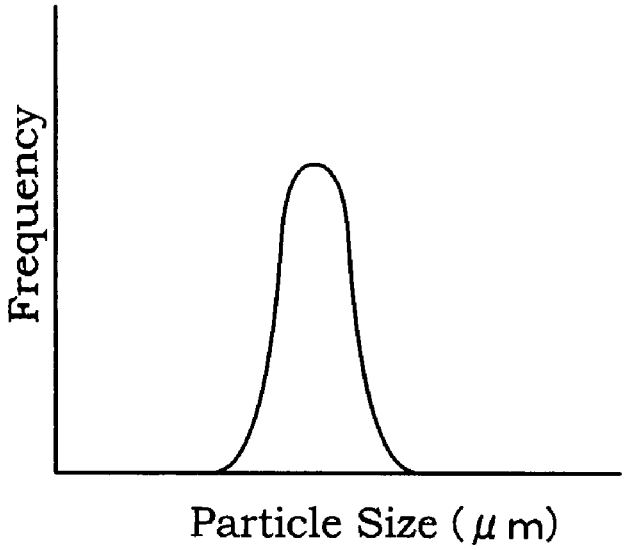
FIG. 2A is a graph showing a narrow particle-size distribution of a resin-coated sand.
Figure 2B:
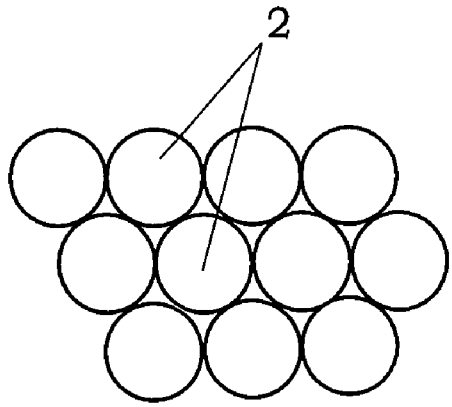
FIG. 2B is a schematic view showing a filling state of the resin-coated sand having the narrow particle-size distribution.

From the viewpoint of uniformly supplying the steam into the cavity, it is also preferred that the control parameter for the electromagnetic valve comprises a void fraction of the resin-coated sand 2 filled in the cavity. That is, as shown in FIGS. 2A and 2B, when the resin-coated sand 2 has a narrow particle-size distribution, relatively large voids occur among particles of the resin-coated sand filled in the cavity, so that the void fraction becomes relatively large. In this case, the superheated steam supplied in the cavity can easily penetrate into the resin-coated sand through these voids to increase the steam amount discharged through the steam discharge passage 20. As a result, there is a fear that the steam amounts discharged through the steam discharge passages (21, 22) decrease. In such a case, according to the present invention, the operations of the electromagnetic valves are controlled by the control unit 4 so as to reduce the opening amount of the electromagnetic valve located in the steam discharge passage 20, and at the same time increase the opening amounts of the electromagnetic valves located in the steam discharge passages (21, 22).

Figure 3A:
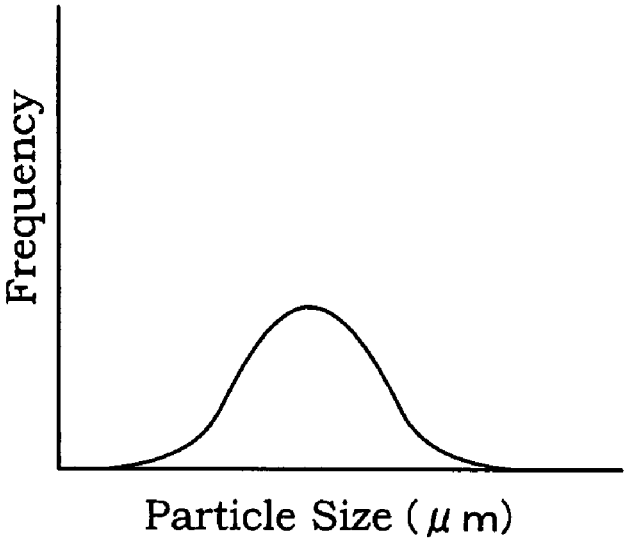
FIG. 3A is a graph showing a wide particle-size distribution of a resin-coated sand.
Figure 3B:
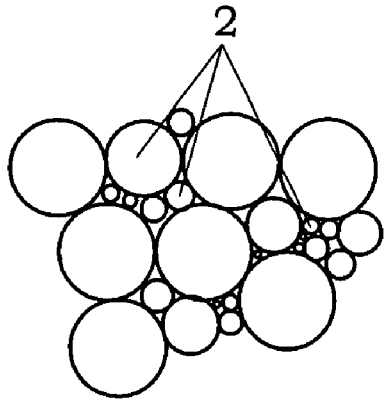
FIG. 3B is a schematic view showing a filling state of the resin-coated sand having the wide particle-size distribution.

On the other hand, as shown in FIGS. 3A and 3B, when the resin-coated sand 2 has a wide particle-size distribution, small-sized particles are positioned in a void formed among relatively large-sized particles of the resin-coated sand filled in the cavity, so that the void fraction becomes relatively small. In this case, the superheated steam supplied in the cavity becomes hard to penetrate into the resin-coated sand. Therefore, it is needed to increase the opening amount of the electromagnetic valve located in the steam discharge passage 20, as compared with the case of using the resin-coated sand having the small particles-size distribution. As a result, since the steam amounts discharged through the steam discharge passages (21, 22) may decrease, the suction pump is controlled to increase the steam discharge amount. In brief, the operations of the electromagnetic valves and the suction pump are controlled by the control unit 4 such that the opening amount of the electromagnetic valve located in the steam discharge passage 20 is slightly increased to ensure that the steam reaches the entrance of the steam discharge passage 20, and on the other hand the opening amounts of the electromagnetic valves located in the steam discharge passages (21, 22) are sufficiently increased to ensure that the steam reaches the entrances of the steam discharge passages (21, 22), and also the discharge amount of the suction pump is increased.

In addition, when producing a thick-walled casing mold, there is a fear that heat is not sufficiently supplied into a core portion of the resin-coated sand filled in the cavity, so that only a part of the resin-coated sand which contacts an inner surface of the heated mold is cured. In the past, the metal mold has been heated at a high temperature to solve this problem. However, since a toxic gas occurs at the time of curing the binder material at the high temperature, a deterioration of working conditions was unavoidable. According to the present invention, since the steam is forcibly sucked into the steam discharge passages, it is possible to reliably achieve a uniform supply of heat into the core portion of the resin-coated sand filled in the cavity. Therefore, the casing mold can be produced under improved safe working conditions. In addition, it is not needed to heat the mold at the high temperature, as compared with the past. Furthermore, there is an advantage that a heat-resistant resin material other than the metal material can be used as the mold material. In this case, an increase in degree of freedom of designing the mold and a reduction in production cost can be achieved.

In addition, it is preferred to control the opening amounts of the electromagnetic valves in consideration of the void fraction by previously determining the void fraction of the resin-coated sand filled in the mold by a preliminary experiment, and inputting this void fraction through an input portion (not shown) formed in the control unit 4. For example, the void fraction is defined as a numerical value measured by the following method.

First, 100 ml of a mixture solution prepared such that a weight ratio of water:methanol is 7:3 is put in a measuring cylinder having a volume of 200 ml. Next, 100 ml of the resin-coated sand, which is measured by use of another measuring cylinder, is gradually added to the mixture solution, and then the measuring cylinder is sealed. After it is confirmed that the occurrence of air bubbles has stopped, a liquid level in the measuring cylinder is read off. The void fraction is provided by a difference between the liquid level (M ml) and the scale of 200 ml. Therefore, the void fraction (%) is defined as 200-M. As the solution, water including an interfacial active agent or another liquid may be used in place of the mixture of water and methanol.

A method for producing the casing mold with use of the apparatus described above is explained below in detail. First, the resin-coated sand 2 is injected into the heated mold 1 by the sand supply unit 3. The resin-coated sand can be prepared by coating a refractory aggregate with a binder material (binder resin) such as a thermosetting resin. As the thermosetting resin, for example, it is possible to use a phenol resin, furan resin, isocyanate resin, amine polyol resin or a polyether polyol resin. The mold is preferably heated at a curing temperature or more of the resin-coated sand, for example, 130° C. to 200° C.

Next, the superheated steam is supplied into the cavity 40 of the mold 1 by the steam supply unit 7 to cure the resin-coated sand The superheated steam preferably has the curing temperature or more of the resin-coated sand 2, for example, 200° C. to 600° C., and a steam pressure of 1.5~10 kgf/cm$^2$. After the superheated steam supplied in the cavity heats the resin-coated sand at the temperature needed for curing, it is discharged from the cavity through the steam discharge passages (20, 21, 22). At this time, the electromagnetic valves (30, 31, 32) and the suction pump 5 are controlled by the control unit 4 such that the cavity is uniformly filled with the superheated steam.

According to the present invention, since the steam discharge passages are formed at different locations to forcibly discharge the superheated steam from the cavity, the superheated steam can be uniformly supplied all over the cavity. Therefore, even when producing the casing mold of a complex shape, it is possible to remarkably reduce the treatment time needed to cure the casing mold, and prevent variations in quality to stably provide the casting mold with uniform quality. In addition, when the binder material of the thermosetting resin is cured by use of the superheated steam, the occurrence of a toxic gas such as ammonia, formaldehyde and phenol can be remarkably reduced. Furthermore, even when a small amount of the toxic gas is generated, it is absorbed by the steam, and then discharged to prevent that the working conditions are deteriorated by the occurrence of the toxic gas. Thus, it is possible to achieve improvements in yield ratio and production efficiency of the casing mold, while preventing the deterioration of working conditions.

After the supply of superheated steam is continued until the curing of the resin-coated sand is completed, the casing mold of the cured resin-coated sand is removed from the cavity. To prevent that the moisture remains in the produced casing mold, the casing mold may be dried by a drying device. By the way, according to the present invention, since the steam uniformly supplied all over the cavity of the complex shape is forcibly removed through the steam discharge passages, dew condensation of the steam is hard to happen in the interior of the casing mold. Therefore, the drying process described above may be omitted.

In the above explanation, a single supply passage is used to supply the resin-coated sand and the superheated steam into the cavity. However, a plurality of supply passages may be formed depending on the shape and size of the cavity. In addition, the apparatus described above has three steam discharge passages. According to the shape of the cavity, two or four or more of the steam discharge passages may be formed at suitable locations. Moreover, it is not essential in the present invention that each of the steam discharge passages has the electromagnetic valve. Further, the suction pump may be connected to only a predetermined one or more of the steam discharge passages.

EXAMPLES

Examples 1-3 and Comparative Examples 1-3

The present invention is concretely explained below according to Examples.

A resin-coated sand used in the subject Examples was prepared, as described below. First, 680 parts by weight of phenol, 680 parts by weight of 37% formalin and 101 parts by weight of hexamethyltetramine were put in a reaction vessel. A resultant mixture was heated up to 70° C. by taking about 60 minutes, and then reacted by keeping as it is for 5 hours. The thus obtained reaction product was dewatered at 90° C. under a reduced pressure of 100 Torr, and then cooled to obtain a resol-type phenol resin having a softening point of 80° C.

Next, 30 kg of a Flattery sand heated at 145° C. and 450 g of the resol-type phenol resin were put in a Wahl mixer, and kneaded for 30 seconds. Subsequently, 450 g of water was added to the mixer, and a resultant mixture was further kneaded until sand particles are disrupted. After 30 g of calcium stearate was further added to the mixer, and a resultant mixture was kneaded for 30 seconds, aeration was performed to obtain a resin-coated sand having a resin amount of 1.5% by weight ratio. A void fraction of the resin-coated sand is 42%.

To produce the casting mold, the apparatus of FIG. 1 was used. The resin-coated sand 2 described above was injected at a pressure of 2.5 MPa from the sand supply unit 3 connected to the steam supply passage 10 into the cavity 40 of the metal mold 1 heated at 160° C. Next, the sand supply unit 3 was disconnected from the steam supply passage 10, and the steam supply unit 7 was connected to the steam supply passage 10. A saturated steam of 165° C. was generated under a pressure of 7 kgf/cm$^2$ by the steam generator 70, and then superheated by the heating device 72 to obtain superheated steam of 400° C. The superheated steam was supplied for 10, 20 or 30 seconds into the cavity 40 having the resin coated sand 2 therein to produce the casting mold. The casting molds of Comparative Examples 1 to 3 were produced by use of an apparatus, which has the same cavity shape, but does not have the electromagnetic valve as the flow regulator, the suction pump and the control unit.

TABLE 1

| | Steam Supply | Temperature of Steam Discharge Passage | | | Quality of Casting |
|---|---|---|---|---|---|
| | Time (sec) | 20 | 21 | 22 | Mold |
| Example 1 | 10 | 115 | 113 | 115 | ○ |
| Example 2 | 20 | 123 | 122 | 121 | ○ |
| Example 3 | 30 | 132 | 130 | 129 | ○ |
| Comparative Example 1 | 10 | 125 | 82 | 79 | X |
| Comparative Example 2 | 20 | 134 | 93 | 90 | X |
| Comparative Example 3 | 30 | 138 | 108 | 110 | Δ |

Temperatures measured at the vicinities of the entrances of the respective steam discharge passages (20, 21, 22) and evaluation results of the casting molds, each of which was removed from the metal mold, are shown in Table 1. As the evaluation standards, "○" designates that the casting mold has good quality, "Δ" designates that the casting mold partially has an uncured portion, and "X" designates that the casting mold is unusable.

In Examples 1 to 3, the temperatures of the steam discharge passages are relatively uniform. In addition, even when the steam was supplied for a short time period, the inside of the cavity was uniformly heated. As a result, the casting molds with stable quality were obtained. On the other hand, in Comparative Examples 1 to 3, since the suction of the steam into the steam discharge passages was not controlled, the temperatures measured at the vicinities of the entrances of the steam discharge passages (21, 22) were relatively low. In addition, as the steam supply time was longer, the quality of the casing mold was slightly improved. However, when the steam supply time was short, a defective casing mold occurred due to nonuniform temperature distribution in the cavity.

Thus, the results of the subject Examples show that the casting mold having the complex shape can be stably produced by supplying the steam for the short time period.

Examples 4-6 and Comparative Examples 4-6

A resin-coated sand used in the subject Examples was prepared according to the substantially same manner as the Examples 1 to 3 except for using Unimin 90 sand in place of the Flattery sand. A void fraction of this resin-coated sand is 37%. By using this resin-coated sand, casting molds were produced as in the cases of Examples 1 to 3 and Comparative Examples 1 to 3. Results are shown in Table 2.

TABLE 2

| | Steam Supply | Temperature of Steam Discharge Passage | | | Quality of Casting |
|---|---|---|---|---|---|
| | Time (sec) | 20 | 21 | 22 | Mold |
| Example 4 | 10 | 108 | 107 | 106 | ○ |
| Example 5 | 20 | 118 | 113 | 113 | ○ |
| Example 6 | 30 | 125 | 122 | 123 | ○ |
| Comparative Example 4 | 10 | 114 | 85 | 87 | X |
| Comparative Example 5 | 20 | 123 | 89 | 91 | X |
| Comparative Example 6 | 30 | 131 | 93 | 94 | X |

According to the present invention, since the inside of the cavity was uniformly heated by controlling the temperatures of the steam discharge passages relatively uniform, the casing mold with stable quality could be produced irrespective of using the resin-coated sand with a lower void fraction. On the other hand, in the Comparative Examples 4 to 6, the temperature distribution in the cavity became nonuniform due to the decrease in void fraction of the resin-coated sand. In addition, even when the steam supply time was extended at the maximum, sufficiently high temperatures were obtained at the steam discharge passages (21, 22). Consequently, usable casing molds were not obtained by the steam supply times adopted in the subject Comparative Examples.

Thus, the results of the subject Examples show that even when using the resin-coated sand with a low void fraction, the casting mold having the complex shape can be efficiently produced by supplying the steam for the short time period.

INDUSTRIAL APPLICABILITY

As described above, in the case of producing the casing mold having a complex shape, the present invention can achieve a remarkable effect that the resin-coated sand can be uniformly cured in the mold by increasing a supply amount of superheated steam into intricate portions. In addition, it is possible to efficiently produce the casting mold with stable quality, and flexibly cope with the production of various shapes of the casing molds, without detracting the advantages brought by the conventional method for producing the casing mold by use of the superheated steam, which is disclosed in Japanese Patent Early Publication No. 2000-107835. Thus, according to the present invention, it is expected that the method of producing the casing mold by use of the superheated steam will become more widely utilized.

The invention claimed is:

1. An apparatus for producing a casting mold comprising:

a mold having a cavity therein, wherein a resin-coated sand, which is prepared by coating a refractory aggregate with a binder resin, is filled in the cavity;

a steam supply unit configured to supply superheated steam into said cavity;

a plurality of steam discharge passages configured to discharge the superheated steam from said cavity;

a flow regulator disposed at least one of said steam discharge passages to regulate an amount of the steam discharged from said cavity; and a control unit configured to separately control an opening amount of each of said flow regulator such that said cavity is uniformly filled with the superheated steam.

2. The apparatus as set forth in claim 1, further comprising a temperature sensor located in the vicinity of an entrance of each of said steam discharge passages, and wherein said control unit controls said flow regulator such that a temperature detected by said temperature sensor is within a predetermined temperature range.

3. The apparatus as set forth in claim 1, wherein said flow regulator comprises an electromagnetic valve, and said control unit controls an opening amount of said electromagnetic valve.

4. The apparatus as set forth in claim 1, further comprising a suction pump connected to at least one of said steam discharge passages, and wherein said control unit controls a discharge amount of said suction pump.

5. The apparatus as set forth in claim 1, wherein said flow regulator comprises an electromagnetic valve, and a suction pump is connected to a discharge port, which is formed at a confluence portion of ends of said steam discharge passages, wherein said control unit controls an opening amount of said electromagnetic valve and a discharge amount of said suction pump.

6. The apparatus as set forth in claim 1, wherein said control unit controls said flow regulator according to a void fraction of a resin-coated sand filled in said cavity.

7. A method for producing a casting mold by use of an apparatus comprising a mold having a cavity therein, a steam supply unit configured to supply superheated steam into said cavity, a plurality of steam discharge passages configured to discharge the superheated steam from said cavity, a flow regulator disposed at at least one of said steam discharge passages to regulate an amount of the steam discharged from said cavity, and a control unit configured to control said flow regulator such that said cavity is uniformly filled with the superheated steam, wherein the method comprises the steps of:

filling a resin-coated sand, which is prepared by coating a refractory aggregate with a binder resin, in said cavity of said mold heated at an increased temperature; and curing said resin-coated sand by supplying the superheated steam into said cavity under a steam pressure of 1.5~10 $kgf/cm^2$ at a curing temperature or more of said resin-coated sand;

wherein said is configured to separately control an opening amount of each of unit controls said flow regulator in said curing step such that said cavity is uniformly filled with the superheated steam.

8. The method as set forth in claim 7, wherein the apparatus comprises a temperature sensor located in the vicinity of an entrance of each of said steam discharge passages, and said control unit controls said flow regulator such that a temperature detected by said temperature sensor is within a predetermined temperature range.

9. The method as set forth in claim 7, wherein the apparatus comprises a suction pump connected to at least one of said steam discharge passages, and said control unit controls a discharge amount of said suction pump.

10. The method as set forth in claim 7, wherein said control unit controls said flow regulator according to a control parameter comprising at least one of a temperature in said steam discharge passage, and a void fraction of said resin-coated sand filled in said cavity.

* * * * *